US010252855B1

(12) United States Patent
Melancon, Jr.

(10) Patent No.: US 10,252,855 B1
(45) Date of Patent: Apr. 9, 2019

(54) RAMP WALL FOR A CONTAINER

(71) Applicant: Dennis Wayne Melancon, Jr., Lynchburg, VA (US)

(72) Inventor: Dennis Wayne Melancon, Jr., Lynchburg, VA (US)

( * ) Notice: Subject to any disclaimer, the term of this patent is extended or adjusted under 35 U.S.C. 154(b) by 0 days.

(21) Appl. No.: 16/007,383

(22) Filed: Jun. 13, 2018

Related U.S. Application Data

(63) Continuation of application No. 15/910,637, filed on Mar. 2, 2018.

(51) Int. Cl.
*B65D 51/24* (2006.01)
*B65D 90/62* (2006.01)
*B65D 43/14* (2006.01)

(52) U.S. Cl.
CPC ..... *B65D 90/623* (2013.01); *B65D 2590/666* (2013.01)

(58) Field of Classification Search
CPC ..... B65D 90/623; B65D 2590/666
USPC ... 220/844, 660, 830, 817, 4.34, 818, 558, 7
See application file for complete search history.

(56) References Cited

U.S. PATENT DOCUMENTS 733,552 A * 7/1903 MacDonald ..... B65D 7/24 220/4.34
845,596 A * 2/1907 Thieler ..... B65D 11/1833 220/324
3,093,259 A * 6/1963 Morrison ..... B65D 11/1873 220/4.34
3,602,388 A * 8/1971 Hurkamp ..... B65D 7/26 217/14
5,957,322 A * 9/1999 Pugh ..... B67D 1/08 220/23.88
8,061,553 B2 * 11/2011 McKeen ..... B65D 85/38 220/811
8,292,107 B1 * 10/2012 Hong ..... B65D 90/08 220/1.5
9,440,786 B2 * 9/2016 Giesbers ..... B65D 88/524
2003/0150769 A1 * 8/2003 Lau ..... B65D 88/005 206/600
2006/0028048 A1 * 2/2006 Brenneman ..... B60J 5/108 296/146.8
2008/0029510 A1 * 2/2008 Fisk ..... B65D 88/022 220/7

(Continued)

*Primary Examiner* — J. Gregory Pickett
*Assistant Examiner* — Niki M Eloshway
(74) *Attorney, Agent, or Firm* — Laubscher & Laubscher, P.C.

(57) ABSTRACT

A ramp wall includes a load-bearing support structure having top, bottom and side edges. A first pivot assembly is connected with the support structure bottom edge and adapted for removable connection with at least one container wall. The first pivot assembly includes at least one counter balancing torsion spring that is connected with the bottom edge of the support structure. The spring has a torque force that is generally equal to the gravitational torque force generated by the weight of the ramp wall when it is connected with at least one container wall, allowing manual operation of the ramp wall between a vertical closed position and a horizontal or inclined open position. A second pivot assembly is connected with one of the support structure side edges and adapted for removable connection with a container side wall for swinging movement about a vertical axis between a vertical open position and a vertical closed position.

13 Claims, 4 Drawing Sheets

(56) References Cited

U.S. PATENT DOCUMENTS

2014/0175090 A1* 6/2014 Bellehumeur ..... B65D 88/524
220/1.5

* cited by examiner

FIG. 1
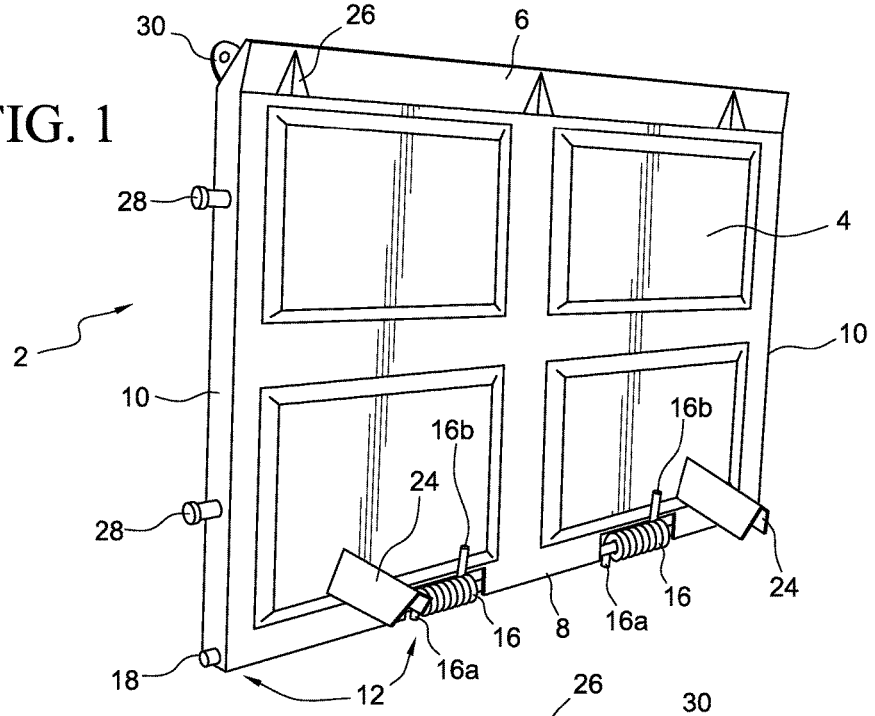
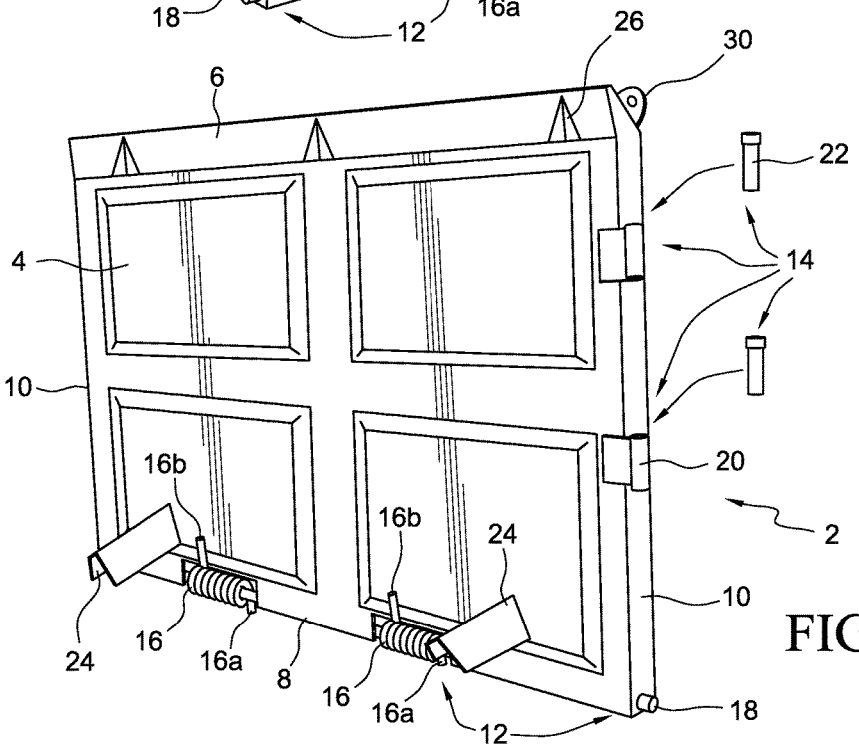
FIG. 2

RAMP WALL FOR A CONTAINER

This application is a continuation of U.S. patent application Ser. No. 15/910,637 filed Mar. 2, 2018.

BACKGROUND OF THE INVENTION

The present invention relates generally to industrial containers for transporting and storing landscaping materials, and more specifically to a ramp wall for such containers.

Industrial containers are used for a range of purposes, including hauling trash, work materials, debris, or any other material with a mass that requires a load bearing, rigid structure. The materials that are typically placed in these containers can be heavy and difficult to manage, often times requiring the use of heavy-duty equipment to load and unload them. The loading equipment may include things such as a backhoe, crane, large truck, or other similar device. When these devices haul, load and unload materials, it is beneficial to provide an opening at one end of the container to allow for easier loading and unloading.

Beyond the benefits providing an opening at the end of a container, it can be even more beneficial to provide a ramp wall having a load-bearing structure which can support the weight of a backhoe, truck or similar device. Such a ramp wall includes the structural enclosure features of a side or back wall along with the capabilities of a ramp. This allows for securing heavy materials within the container and also a structure by which heavy equipment can enter the container at one end and more easily load or unload materials in and out of the container.

Applicant owns a number of patents relating to containers with a ramp wall. The Melancon U.S. Pat. No. 9,067,524 discloses a container with a ramp wall that can be pivotally displaced between a vertical closed position and a horizontal loading position by way of a hydraulic motor. The Melancon U.S. Pat. No. 9,884,575 patent discloses a similar ramp wall but uses helical counter-balancing springs that bias the ramp wall instead of a hydraulic motor. Prior load-bearing walls of industrial containers could not be manually displaced with such ease.

Though the ramp walls discussed above are beneficial and provide improved ease of loading and unloading of materials by large pieces of equipment, they can make loading and unloading of lighter materials that do not require heavy equipment more challenging than it would otherwise be with a door or other non-ramp wall structure. Thus, there is a need for a ramp wall or similar device that can provide both the loading capabilities of the containers and ramp walls of the aforementioned Melancon patents, but also allow for easier access to the container when such heavy-duty loading is not needed, similar to containers that have a door rather than a ramp wall. A ramp wall and door have been used separately with containers, but a single device that serves as both a ramp and a door is needed.

SUMMARY OF THE INVENTION

Accordingly, it is an object of the present invention to provide for a load-bearing ramp wall that can pivot between a horizontal or inclined open position and vertical closed position to function as a ramp and can also swing between a vertical closed position and vertical open position to function as a door.

It is further an object of the present invention to provide a container that includes a ramp wall that is removably connected at one end of the container to pivot between a horizontal or inclined open position and a vertical closed position and also swing between a vertical closed position and a vertical open position.

In one preferred embodiment of the present invention, a ramp wall includes a load-bearing support structure having top, bottom and side edges. A first pivot assembly is connected with the support structure bottom edge and adapted for removable connection with at least one container wall. The first pivot assembly includes at least one counter balancing torsion spring that is connected with the bottom edge of the support structure. The spring has a torque force that is generally equal to the gravitational torque force generated by the weight of the ramp wall when it is connected with at least one container wall. The torsion spring biases the ramp wall allowing for manual operation of the ramp wall between a vertical closed position and a horizontal or inclined open position. A second pivot assembly is connected with one of the support structure side edges and adapted for removable connection with a container side wall for swinging movement about a vertical axis between a vertical open position and a vertical closed position.

When the ramp wall first pivot assembly is connected with a container wall, the second pivot assembly is disconnected to allow pivotal movement of the ramp wall between the horizontal or inclined open position and the vertical closed position. Alternatively, when the ramp wall second pivot assembly is connected with a container side wall, the first pivot assembly is disconnected to allow pivotal movement of the ramp wall between the vertical open position and the vertical closed position.

In another embodiment, the first pivot assembly includes at least one horizontal pivot shaft extending transversely of the support structure bottom edge about which the helical torsion spring is arranged. The pivot shaft provides a removable connection of the support structure lower edge with a container.

In another embodiment of the present invention, the second pivot assembly includes at least one hinge knuckle that is connected to a side edge of the support structure for removable connection with a container side wall. The hinge knuckle can be secured to a container side wall into by a locking pin arranged within the knuckle when it is aligned with a container side wall knuckle.

In yet another embodiment, a container having a ramp wall is provided. The container has a rectangular container body with a horizontal bottom wall, a pair of vertical side walls, and a vertical rear end wall to define a chamber that is open at one end. At the open end there is a ramp wall which includes a load-bearing support structure having top, bottom and side edges, a first pivot assembly, and a second pivot assembly, as is described in connection with the ramp wall above. When the ramp wall first pivot assembly is connected with a container wall, the second pivot assembly is disconnected to allow pivotal movement of the ramp wall between the horizontal or inclined open position and the vertical closed position. Alternatively, when the ramp wall second pivot assembly is connected with a container side wall, the first pivot assembly is disconnected to allow pivotal movement of the ramp wall between the vertical open position and the vertical closed position.

BRIEF DESCRIPTION OF THE DRAWINGS

Other objects and advantages of the disclosure will become apparent from a study of the following specification when viewed in the light of the accompanying drawing, in which:

FIGS. 1 and 2 are perspective views of a first embodiment of the ramp wall of the present disclosure;

DETAILED DESCRIPTION

Figure 3:
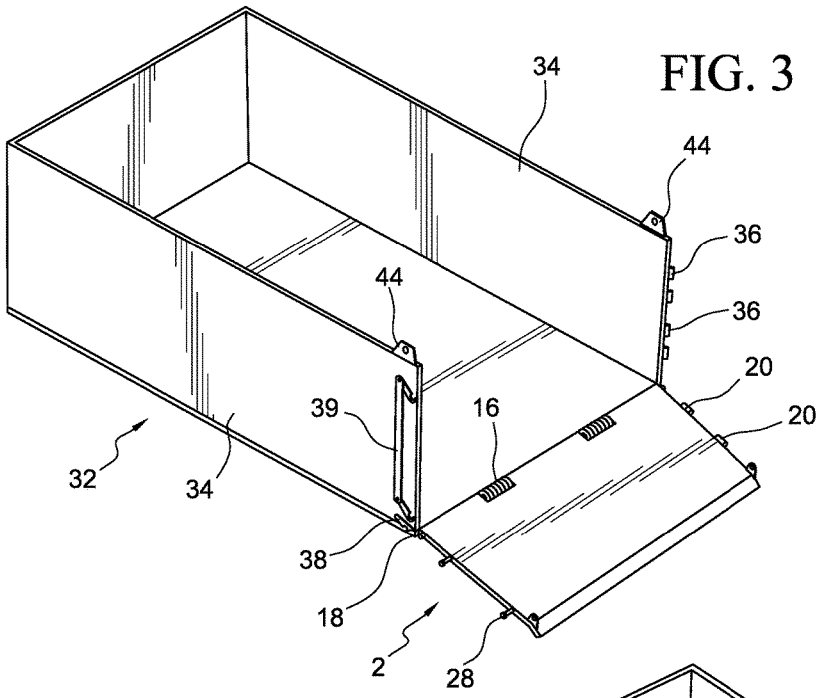
FIGS. 3 and 4 are perspective views of another embodiment of the ramp wall of the present disclosure.

Referring to FIGS. 1 and 2, there is shown a ramp wall 2 including a load-bearing support structure 4 having top 6, bottom 8 and side edges 10, a first pivot assembly 12, and a second pivot assembly 14. The first pivot assembly includes two counter balancing torsion springs 16 arranged concentrically about a horizontal pivot shaft 18 which extends from one ramp wall side edge, through a bottom portion of the support structure, and through the opposite side edge of the ramp wall. Each torsion spring includes first 16*a* and second 16*b* tangentially outwardly extending end portions that engage downwardly with the container bottom wall and upwardly with the ramp wall support structure, respectively. The torsion springs have a torque force that is generally equal to the gravitational torque force generated by the weight of the ramp wall when it is connected with at least one container wall. The pivot shafts about which the springs are arranged extend outwardly from the ramp wall bottom side edges for connection with a container.

The second pivot assembly 14 provides for swinging movement between a vertical open position and vertical closed position. The assembly includes two hinge knuckles 20 attached to and extending laterally from one side edge 10 of the support structure, and two locking pins 22 that are to be arranged within the hinge knuckles for removable connection with a container side wall.

The ramp wall includes two sets of support arms 24 and 26. A first pair of horizontal support arms 24 extends outwardly from the outer surface of the ramp wall at a lower portion thereof. The horizontal support arms provide structural support to the ramp wall when it is in its horizontal or inclined open position for allowing heavy-duty equipment, such as a truck, to remain on or pass over it. A set of three vertical support arms 26 extend downwardly from the top edge 6 of the support structure to provide structural support to the ramp wall when in its horizontal or inclined open position.

Figure 8:
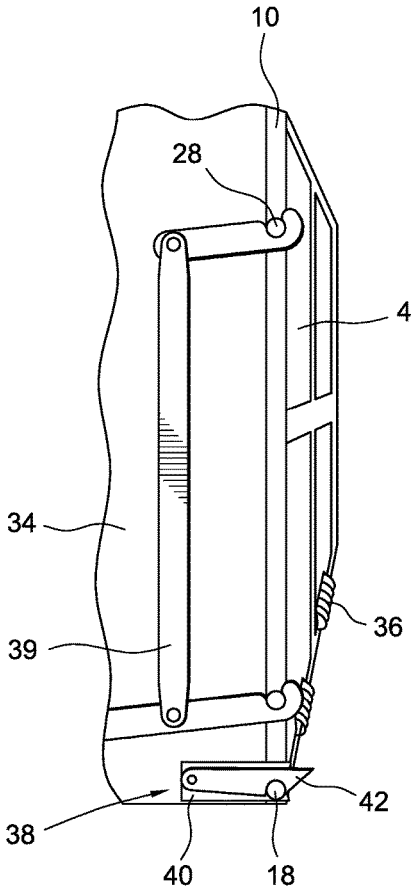

FIG. 1 shows two cylindrical shafts 28 extending outwardly from a side edge of the support structure 10. When the ramp wall is in its closed vertical position, the shafts align with a locking assembly of a container side wall, as shown in FIG. 8, to further secure the ramp wall.

At an upper portion of each support structure side edge 10, there is a wall portion 30 extending laterally therefrom with an opening thereon. The opening aligns with an opening in a wall portion 44 of a container, as shown in FIGS. 3 and 4, when the ramp wall is in its vertical closed position, providing another method for locking the ramp wall to a container body by way of a pad lock or similar locking device.

Figure 4:
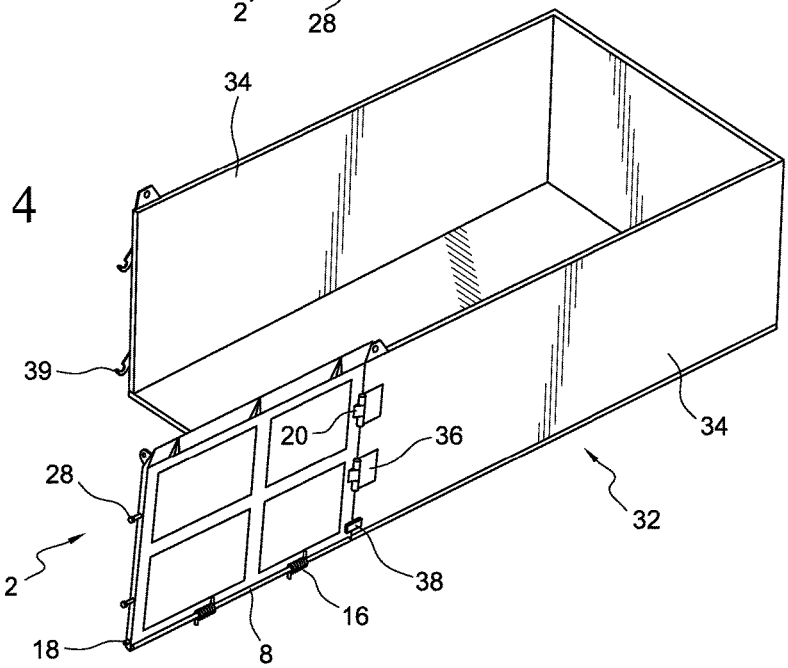

Referring now to FIGS. 3 and 4, a container 32 with the ramp wall 2 is shown. The container of FIG. 3 shows the ramp wall 2 of FIGS. 1 and 2 connected with a lower edge of the container side walls 34 via the ramp wall pivot shaft 18 of the first pivot assembly 12. The pivot shaft connects with a first container side wall locking assembly 38, and the torsion springs 16 bias the ramp wall to allow it to pivot from its horizontal or inclined open position to a vertical closed position. The cylindrical shafts 28 extending outwardly from the ramp wall side edge connect with a second container side wall locking assembly 39.

FIG. 4 shows a container 32 with the ramp wall 2 of FIGS. 1 and 2 connected to a side wall 34 of the container via the ramp wall hinge knuckles 20 of the second pivot assembly 14. The hinge knuckles connect with the container side wall hinge knuckles 36 and are locked into position by the locking pins 22, allowing for swinging movement between its vertical open position and its vertical closed position. The ramp wall pivot assemblies can be easily connected and disconnected to provide an easy transition between the horizontal pivotal movement and vertical swinging movement.

Figure 5:
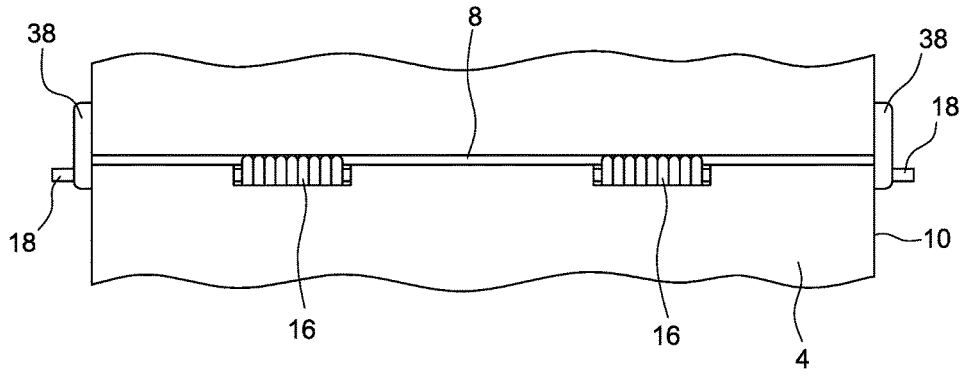
FIG. 5 is a top plan view of one embodiment of the ramp wall connected with a container when in its horizontal or inclined open position.
Figure 6:
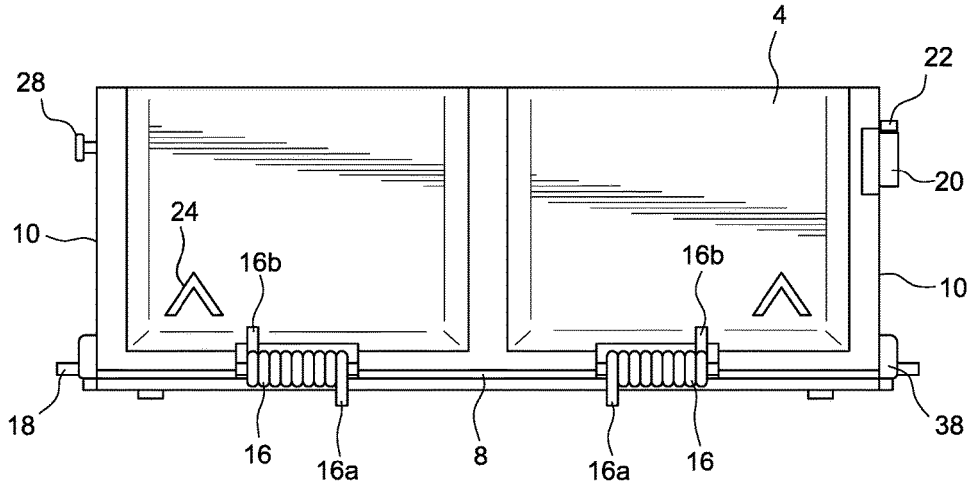
FIG. 6 is a front plan view of the first embodiment of the ramp wall connected with a container when in its vertical close position.
Figure 7:
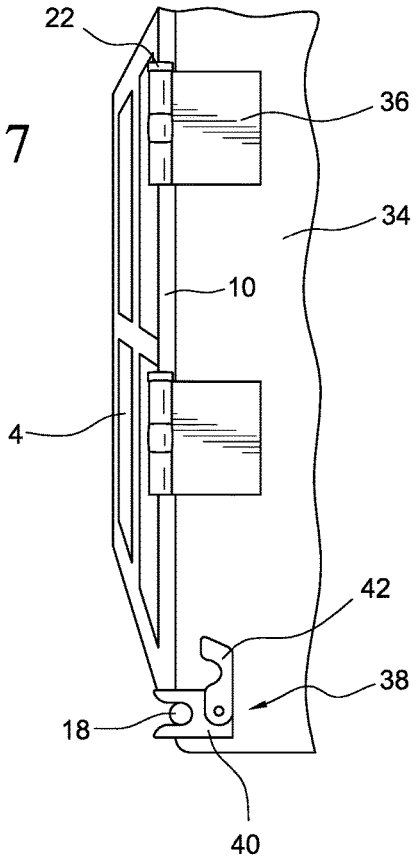
FIGS. 7 and 8 are perspective side views of the first embodiment of the ramp wall connected with a container when in its vertical closed position.

FIGS. 5 and 6 show the ramp wall connected with a container when in its horizontal or inclined open position and vertical closed position, respectively. In its horizontal or inclined open position, the pivot shaft 18 that extends horizontally through a bottom portion of the ramp wall support structure and through the side edges 10 of the ramp wall 2 secures the helical torsion springs 16 and is connected to the container side walls 34 by the first container locking assembly 38. The first 16*a* and second 16*b* tangentially outwardly extending end portions contact the container bottom wall and the ramp wall, respectively, to engage the force of the spring when being lowered or raised. As shown in FIGS. 7 and 8, when the ramp wall is in its vertical closed position, in addition to the pivot shaft which remains connected to the first locking assembly, the cylindrical shafts 28 are connected with the container side wall by a second locking assembly 39 and a ramp wall knuckle 20 is connected with a container side wall hinge knuckle 36 and locked into place by a locking pin 22. At this time, the first 38 and second 39 container locking assemblies can be released and the ramp wall is free to swing to its open vertical position as shown in FIG. 4.

FIGS. 7 and 8 show the ramp wall side edges 10 of the ramp wall 2 of FIGS. 1 and 2 when it is in its vertical closed position and connected with container side walls 34 on each side. In FIG. 7, the pivot shaft 18 is shown extending horizontally through a bottom portion of the ramp wall support structure 4 through the side edges 10 to a pair of support arms 40 connected with the container side wall. A locking arm 42 extends over the support arm opening to lock the pivot shaft in place. In FIG. 7 the pivot shaft is held within the support arm and the locking arm is in its retracted, unlocked state, while in FIG. 8, the pivot shaft is held within the support arm and the locking arm is in its extended, locked state.

FIG. 7 shows the hinge knuckles 20 of the ramp wall side edge 10 connected with the hinge knuckles 36 of the container side wall 34 which are locked in place by locking pins 22. In this state, the first 38 and second 39 container locking assemblies shown in FIG. 8 can be moved to their retracted position, releasing the pivot shaft 18 and cylindrical shafts 28 of the support structure side edge, allowing the ramp wall to swing to its vertical open position. Alternatively, the locking assemblies can remain in their extended, locked position and the locking pins can be removed from the ramp wall and container wall hinge knuckles, allowing the ramp wall to pivot to its horizontal or inclined open position.

The ramp walls of FIGS. 1 and 2 can be connected with an existing container that has been retroactively adjusted to include the connections and locking assemblies of the containers described herein. This retroactive adjustment provides the proper connections and locking assemblies needed to allow the ramp wall 2 to function as described herein. Alternatively, the container with a ramp wall can be newly manufactured to include the ramp wall 2 connected with the container 32 at the outset, rather than retroactively adjusted and fit.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised and employed without departing from the spirit and scope of the present invention as defined by the appended claims.

What is claimed is:

1. A ramp wall for a container, comprising:

(a) a load-bearing support structure having top, bottom and side edges;

(b) a first pivot assembly connected with said support structure and adapted for removable connection with at least one container wall, said first pivot assembly including at least one horizontal pivot shaft extending through said support structure side edges and adapted for removable connection with a container side wall, and at least one counter balancing helical torsion spring arranged on said pivot shaft and having a torque force that is generally equal to the gravitational torque force generated by the weight of the ramp wall when said pivot shaft is connected with the container, said torsion spring biasing the ramp wall to permit manual operation of the ramp wall between a vertical closed position and one of a horizontal and inclined open position; and (c) a second pivot assembly connected with one of said support structure side edges and adapted for removable connection with a container side wall for swinging movement about a vertical axis between a vertical open position and a vertical closed position, whereby when said ramp wall first pivot assembly is connected with a container wall, said second pivot assembly is disconnected to allow pivotal movement of said ramp wall between one of said horizontal and inclined open position and said vertical closed position, and when said ramp wall second pivot assembly is connected with a container side wall, said first pivot assembly is disconnected to allow pivotal movement of said ramp wall between said vertical open position and said vertical closed position.

2. A ramp wall for a container as defined in claim 1, wherein said second pivot assembly includes:

(1) at least one hinge knuckle attached to one of said support structure side edges and extending laterally therefrom; and (2) at least one locking pin arranged within said hinge knuckle for removable connection of said hinge knuckle with a container side wall.

3. A ramp wall for a container as defined in claim 1, and further comprising:

(d) at least one horizontal support arm integral with and extending horizontally outwardly from an outer surface of said support structure when the ramp wall is connected with a container and is in said vertical closed position; and (e) at least one vertical support arm integral with and extending downwardly from said support structure top edge when the ramp wall is in said vertical closed position.

4. A ramp wall for a container as defined in claim 3, and further comprising at least one generally cylindrical shaft extending horizontally outwardly from one of said support structure side edges for removable connection of the ramp wall and a locking mechanism connected with a container side wall to interlock with said at least one generally cylindrical shaft to retain the ramp wall in said vertical closed position.

5. A ramp wall for a container as defined in claim 4, and further comprising at least one wall portion extending laterally from a top edge of one of said side edge portions, said wall portion containing an opening for receiving a lock when the ramp wall is in said vertical closed position and said wall portion opening is aligned with a corresponding container opening.

6. A ramp wall for a container as defined in claim 1, wherein each of said torsion springs has a first tangentially outwardly extending end portion that engages with a container bottom wall, and a second tangentially outwardly extending end portion that engages with the ramp wall.

7. A container for transporting and storing bulk materials, comprising:

(a) a rectangular container body having an integral horizontal bottom wall, a pair of integral vertical side walls, and a vertical rear end wall, to define a chamber that is open at one end; and (b) a vertical ramp wall, comprising:

(1) a load-bearing support structure having top, bottom and side edges;

(2) a first pivot assembly connected with said support structure and adapted for removable connection with at least one said container wall, said first pivot assembly including at least one horizontal pivot shaft extending through said support structure side edges and adapted for removable connection with one said container side wall, and at least one counter balancing helical torsion spring arranged on said pivot shaft and having a torque force that is generally equal to the gravitational torque force generated by the weight of the ramp wall when pivot shaft is connected with said container, said torsion spring biasing the ramp wall to permit manual operation of the ramp wall between a vertical closed position and one of a horizontal and inclined open position; and (3) a second pivot assembly connected with one said support structure side edges and adapted for removable connection with one said vertical side wall for swinging movement about a vertical axis between a vertical open position and a vertical closed position, whereby when said ramp wall first pivot assembly is connected with said container wall, said second pivot assembly is disconnected to allow pivotal movement of said ramp wall between one of said horizontal and inclined open position and said vertical closed position, and when said ramp wall second pivot assembly is connected with said container side wall, said first pivot assembly is disconnected to allow pivotal movement of said ramp wall between said vertical open position and said vertical closed position.

8. A container as defined in claim 7, wherein said container body includes:

(1) at least one locking assembly attached to an edge of said container at said container open end, including:

i. a pair of support arms extending horizontally outwardly at said container open end for receiving said pivot shaft; and ii. a locking arm for removable connection of said pivot shaft with said support arm; and (2) at least one hinge knuckle attached to one said vertical side wall at said container open end extending laterally therefrom.

9. A container as defined in claim 7, wherein said ramp wall second pivot assembly includes:

i. at least one hinge knuckle attached to one of said support structure side edges and extending laterally therefrom; and ii. at least one locking pin arranged within said hinge knuckle for removable connection of said hinge knuckle with one said container vertical side walls.

10. A container as defined in claim 7, wherein said vertical ramp wall further comprises:

(4) at least one horizontal support arm integral with and extending horizontally outwardly from an outer surface of said support structure when the ramp wall is in said vertical closed position; and (5) at least one vertical support arm integral with and extending downwardly from said top horizontal edge when the ramp wall is in said vertical closed position.

11. A container as defined in claim 10, wherein said vertical ramp wall further comprises at least one generally cylindrical shaft extending horizontally outwardly from one of said support structure side edges for removable connection of the ramp wall and a locking mechanism connected with one said container side wall to interlock with said at least one generally cylindrical shaft to retain the ramp wall in said vertical closed position.

12. A container as defined in claim 11, wherein said vertical ramp wall further comprises at least one wall portion extending laterally from a top edge of one of said side edge portions, said wall portion containing an opening for receiving a lock when the ramp wall is in said vertical closed position and said wall portion opening is aligned with a corresponding container opening.

13. A container as defined in claim 7, wherein each of said torsion springs has a first tangentially outwardly extending end portion that engages with a container bottom wall, and a second tangentially outwardly extending end portion that engages with the ramp wall.

* * * * *